US007470856B2

(12) United States Patent
Jung et al.

(10) Patent No.: US 7,470,856 B2
(45) Date of Patent: Dec. 30, 2008

(54) METHOD AND APPARATUS FOR REPRODUCING MIDI MUSIC BASED ON SYNCHRONIZATION INFORMATION

(75) Inventors: Doill Jung, Seoul (KR); Gi-Hoon Kang, Seoul (KR)

(73) Assignee: Amusetec Co., Ltd. (KR)

( * ) Notice: Subject to any disclaimer, the term of this patent is extended or adjusted under 35 U.S.C. 154(b) by 1054 days.

(21) Appl. No.: 10/483,214

(22) PCT Filed: Jul. 10, 2002

(86) PCT No.: PCT/KR02/01302

§ 371 (c)(1),
(2), (4) Date: Jan. 7, 2004

(87) PCT Pub. No.: WO03/006936

PCT Pub. Date: Jan. 23, 2003

(65) Prior Publication Data

US 2004/0196747 A1 Oct. 7, 2004

(30) Foreign Application Priority Data

Jul. 10, 2001 (KR) ..... 2001-41325

(51) Int. Cl.
*G10H 1/00* (2006.01)

(52) U.S. Cl. ..... 84/645; 84/609; 84/470 R; 84/477 R

(58) Field of Classification Search ..... 84/470 R, 84/609, 483.1, 613, 477 R, 634, 637, 645
See application file for complete search history.

(56) References Cited

U.S. PATENT DOCUMENTS 4,484,507 A * 11/1984 Nakada et al. ..... 84/612
4,745,836 A * 5/1988 Dannenberg ..... 84/610
5,455,378 A * 10/1995 Paulson et al. ..... 84/610
5,521,323 A * 5/1996 Paulson et al. ..... 84/610
5,521,324 A * 5/1996 Dannenberg et al. ..... 84/612
5,585,585 A * 12/1996 Paulson et al. ..... 84/610
5,693,903 A * 12/1997 Heidorn et al. ..... 84/668
5,715,179 A * 2/1998 Park ..... 702/182
5,852,251 A * 12/1998 Su et al. ..... 84/645
5,869,783 A * 2/1999 Su et al. ..... 84/612
5,908,996 A * 6/1999 Litterst et al. ..... 84/600
5,913,259 A * 6/1999 Grubb et al. ..... 84/610
5,952,597 A * 9/1999 Weinstock et al. ..... 84/609

(Continued)

FOREIGN PATENT DOCUMENTS

JP 6-348259 12/1994

*Primary Examiner*—David S. Warren
(74) *Attorney, Agent, or Firm*—Cantor Colburn LLP

(57) ABSTRACT

A method and apparatus for reproducing MIDI (music instrument digital interface) music based on synchronization information are provided. MIDI performance information is detected from a musical score and/or MIDI data. Synchronization information, which contains real performance onset time information on an onset time at which each of all notes included in the MIDI performance information is estimated to be performed, is generated from the MIDI performance information or a predetermined synchronization information file. MIDI music is reproduced based on a real MIDI performance table, which is generated by matching the MIDI performance information and the synchronization information. Accordingly, even if musical trainees do not have real performance sound played by a desired player, they can reproduce and listen to the player's performing music with only a small amount of score information and synchronization information.

14 Claims, 14 Drawing Sheets

U.S. PATENT DOCUMENTS 6,107,559 A * 8/2000 Weinstock et al. ..... 84/634
6,156,964 A * 12/2000 Sahai et al. ..... 84/470 R
6,166,314 A * 12/2000 Weinstock et al. ..... 84/483.1
6,333,455 B1 * 12/2001 Yanase et al. ..... 84/609
6,376,758 B1 * 4/2002 Yamada et al. ..... 84/612
6,380,473 B2 * 4/2002 Uehara ..... 84/609
6,380,474 B2 * 4/2002 Taruguchi et al. ..... 84/612
7,189,912 B2 * 3/2007 Jung ..... 84/610

* cited by examiner

FIG.3B

| MIDI PERFORMANCE ONSET TIME INFORMATION | MIDI PITCH INFORMATION | MIDI NOTE LENGTH INFORMATION | MIDI NOTE STRENGTH INFORMATION |
|---|---|---|---|
| 0 | 74(D5) | 120 | 64 |
| 120 | 67(G4) | 60 | 64 |
| 180 | 69(A4) | 60 | 64 |
| 240 | 71(B4) | 60 | 64 |
| 300 | 72(C5) | 60 | 64 |
| 360 | 74(D5) | 120 | 64 |
| ... | ... | ... | ... |

FIG.3C

| MIDI PERFORMANCE ONSET TIME INFORMATION | MIDI PITCH INFORMATION | MIDI NOTE LENGTH INFORMATION | MIDI NOTE STRENGTH INFORMATION |
|---|---|---|---|
| 0 | 59(B3) | 240 | 64 |
| 0 | 55(G3) | 240 | 64 |
| 240 | 57(A3) | 90 | 64 |
| 330 | 57(A3) | 30 | 64 |
| ... | ... | ... | ... |

FIG.4A

| REAL PERFORMANCE ONSET TIME INFORMATION | MIDI PERFORMANCE ONSET TIME INFORMATION | MIDI PITCH INFORMATION |
|---|---|---|
| 00:00:00 | 0 | 74(D5) |
| 00:01:00 | 120 | 67(G4) |
| 00:01:50 | 180 | 69(A4) |
| 00:02:00 | 240 | 71(B4) |
| 00:02:50 | 300 | 72(C5) |
| ... | ... | ... |

FIG.4B

| REAL PERFORMANCE ONSET TIME INFORMATION | MIDI PERFORMANCE ONSET TIME INFORMATION | MIDI PITCH INFORMATION | MIDI NOTE LENGTH INFORMATION | MIDI NOTE STRENGTH INFORMATION | PERFORMANCE CLASSIFICATION INFORMATION |
|---|---|---|---|---|---|
| 00:00:00 | 0 | 74(D5) | 120 | 64 | SYNCHRONIZATION |
| (41) | 0 | 59(B3) | 240 | 64 | ACCOMPANIMENT |
| (42) | 0 | 55(G3) | 240 | 64 | ACCOMPANIMENT |
| 00:01:00 | 120 | 67(G4) | 60 | 64 | SYNCHRONIZATION |
| 00:01:50 | 180 | 69(A4) | 60 | 64 | SYNCHRONIZATION |
| 00:02:00 | 240 | 71(B4) | 60 | 64 | SYNCHRONIZATION |
| (43) | 240 | 57(A3) | 90 | 64 | ACCOMPANIMENT |
| 00:02:50 | 300 | 72(C5) | 60 | 64 | SYNCHRONIZATION |
| (44) | 330 | 57(A3) | 30 | 64 | ACCOMPANIMENT |
| ... | ... | ... | ... | ... | ... |

FIG.4C

| REAL PERFORMANCE ONSET TIME INFORMATION | MIDI PERFORMANCE ONSET TIME INFORMATION | MIDI PITCH INFORMATION | MIDI NOTE LENGTH INFORMATION | MIDI NOTE STRENGTH INFORMATION | PERFORMANCE CLASSIFICATION INFORMATION |
|---|---|---|---|---|---|
| 00:00:00 | 0 | 74(D5) | 120 | 64 | SYNCHRONIZATION |
| 00:00:00 | 0 | 59(B3) | 240 | 64 | ACCOMPANIMENT |
| 00:00:00 | 0 | 55(G3) | 240 | 64 | ACCOMPANIMENT |
| 00:01:00 | 120 | 67(G4) | 60 | 64 | SYNCHRONIZATION |
| 00:01:50 | 180 | 69(A4) | 60 | 64 | SYNCHRONIZATION |
| 00:02:00 | 240 | 71(B4) | 60 | 64 | SYNCHRONIZATION |
| 00:02:00 | 240 | 57(A3) | 90 | 64 | ACCOMPANIMENT |
| 00:02:50 | 300 | 72(C5) | 60 | 64 | SYNCHRONIZATION |
| 00:02:75 | 330 | 57(A3) | 30 | 64 | ACCOMPANIMENT |
| ... | ... | ... | ... | ... | ... |

FIG.5A

| REAL PERFORMANCE ONSET TIME INFORMATION | MIDI PERFORMANCE ONSET TIME INFORMATION | MIDI PITCH INFORMATION |
|---|---|---|
| 00:00:00 | 0 | 74(D5) |
| 00:02:00 | 120 | 67(G4) |
| 00:03:00 | 180 | 69(A4) |
| 00:04:00 | 240 | 71(B4) |
| 00:05:00 | 300 | 72(C5) |
| ... | ... | ... |

FIG.5B

| REAL PERFORMANCE ONSET TIME INFORMATION | MIDI PERFORMANCE ONSET TIME INFORMATION | MIDI PITCH INFORMATION | MIDI NOTE LENGTH INFORMATION | MIDI NOTE STRENGTH INFORMATION | PERFORMANCE CLASSIFICATION INFORMATION |
|---|---|---|---|---|---|
| 00:00:00 | 0 | 74(D5) | 120 | 64 | SYNCHRONIZATION |
| (51) | 0 | 59(B3) | 240 | 64 | ACCOMPANIMENT |
| (52) | 0 | 55(G3) | 240 | 64 | ACCOMPANIMENT |
| 00:02:00 | 120 | 67(G4) | 60 | 64 | SYNCHRONIZATION |
| 00:03:00 | 180 | 69(A4) | 60 | 64 | SYNCHRONIZATION |
| 00:04:00 | 240 | 71(B4) | 60 | 64 | SYNCHRONIZATION |
| (53) | 240 | 57(A3) | 90 | 64 | ACCOMPANIMENT |
| 00:05:00 | 300 | 72(C5) | 60 | 64 | SYNCHRONIZATION |
| (54) | 330 | 57(A3) | 30 | 64 | ACCOMPANIMENT |
| ... | ... | ... | ... | ... | ... |

FIG.5C

| REAL PERFORMANCE ONSET TIME INFORMATION | MIDI PERFORMANCE ONSET TIME INFORMATION | MIDI PITCH INFORMATION | MIDI NOTE LENGTH INFORMATION | MIDI NOTE STRENGTH INFORMATION | PERFORMANCE CLASSIFICATION INFORMATION |
|---|---|---|---|---|---|
| 00:00:00 | 0 | 74(D5) | 120 | 64 | SYNCHRONIZATION |
| 00:00:00 | 0 | 59(B3) | 240 | 64 | ACCOMPANIMENT |
| 00:00:00 | 0 | 55(G3) | 240 | 64 | ACCOMPANIMENT |
| 00:02:00 | 120 | 67(G4) | 60 | 64 | SYNCHRONIZATION |
| 00:03:00 | 180 | 69(A4) | 60 | 64 | SYNCHRONIZATION |
| 00:04:00 | 240 | 71(B4) | 60 | 64 | SYNCHRONIZATION |
| 00:04:00 | 240 | 57(A3) | 90 | 64 | ACCOMPANIMENT |
| 00:05:00 | 300 | 72(C5) | 60 | 64 | SYNCHRONIZATION |
| 00:05:50 | 330 | 57(A3) | 30 | 64 | ACCOMPANIMENT |
| ... | ... | ... | ... | ... | ... |

METHOD AND APPARATUS FOR REPRODUCING MIDI MUSIC BASED ON SYNCHRONIZATION INFORMATION

TECHNICAL FIELD

The present invention relates to a method and apparatus for reproducing MIDI (music instrument digital interface) music based on synchronization information, and more particularly, to a method and apparatus for automatically reproducing MIDI music based on synchronization information between MIDI performance information, which is detected from a musical score and/or MIDI data, and performing music.

BACKGROUND ART

Usually, musical training is performed using teaching materials including musical scores with comments and recording media, for example, tapes and compact discs (CDs), for recording music. More specifically, a trainee takes musical training by repeatedly performing a series of steps of listening to music reproduced from a recording medium, performing the music according to a musical score, and recording music performed by himself/herself to check.

For musical training, some trainee repeatedly listen to music performed by famous players and study the players' execution. For such musical training, the trainee need to store real performance sound of music played by the famous players in special recording media, such as tapes and CDs, in the form of, for example, a wave file and manage the recording media. However, real performance sound is usually very big in size, so trainees are troubled to manage many recording media.

In the meantime, when a trainee performs only a part of music, if the trainee's execution, such as performance tempo, is automatically detected, and if the remaining part of the music is automatically performed in accordance with the detected execution, it is expected to accomplish effective musical training.

DISCLOSURE OF THE INVENTION

To solve the above-described problem and to accomplish effective musical training, it is an object of the present invention to provide a method and apparatus for reproducing MIDI (music instrument digital interface) music based on synchronization information.

To achieve the above object of the invention, in one embodiment, a method for reproducing MIDI music includes a first step of detecting MIDI performance information from a musical score and/or MIDI data; a second step of generating synchronization information, which contains real performance onset time information on an onset time at which each of all notes included in the MIDI performance information is estimated to be performed, from the MIDI performance information or a predetermined synchronization information file; a third step of matching the MIDI performance information and the synchronization information to generate a real MIDI performance table for the notes included in the MIDI performance information; and a fourth step of reproducing MIDI music based on the real MIDI performance table.

In another embodiment, a method for reproducing MIDI music includes a first step of detecting MIDI performance information from a musical score and/or MIDI data; a second step of detecting real performance onset time information and pitch information of a current real performing note when real performing music is input and generating synchronization information, which contains real performance onset time information of a MIDI note matched with the current performing note and included in the MIDI performance information, in real time based on the real performance onset time information and pitch information of the current performing note; a third step of generating a real MIDI performance table regarding all notes included in the MIDI performance information by matching the generated synchronization information and the MIDI performance information; and a fourth step of reproducing MIDI music based on the real MIDI performance table.

To achieve the above object of the invention, an apparatus for reproducing MIDI music includes a score input unit for inputting score information containing pitch and note length information of all notes included in a musical score or MIDI data to be played; a MIDI performance information manager for detecting MIDI performance information from the score information and storing and managing the MIDI performance information; a synchronization information manager for generating synchronization information, which contains real performance onset time information on an onset time at which each of the notes included in the MIDI performance information is estimated to be performed, from the MIDI performance information or a predetermined synchronization information file and managing the synchronization information; a real MIDI performance table manager for generating and managing a real MIDI performance table for all of the notes included in the MIDI performance information by matching the MIDI performance information and the synchronization information; and a MIDI music reproducing unit for reproducing MIDI music based on the real MIDI performance table.

BRIEF DESCRIPTION OF THE DRAWINGS

FIGS. 3A through 3C show the musical score of the first two measures of the Minuet in G major by Bach and MIDI performance information detected from the musical score in order to illustrate the present invention.

FIGS. 4A through 4C are diagrams for illustrating a procedure for generating MIDI music in accordance with a synchronized tempo according to the first embodiment of the present invention.

FIGS. 5A through 5C are diagrams for illustrating a procedure for generating MIDI music in accordance with a player's performance tempo according to the second embodiment of the present invention.

BEST MODE FOR CARRYING OUT THE INVENTION

Hereinafter, embodiments of a method and apparatus for reproducing MIDI music based on synchronization information according to the present invention will be described in detail with reference to the attached drawings.

Figure 1:
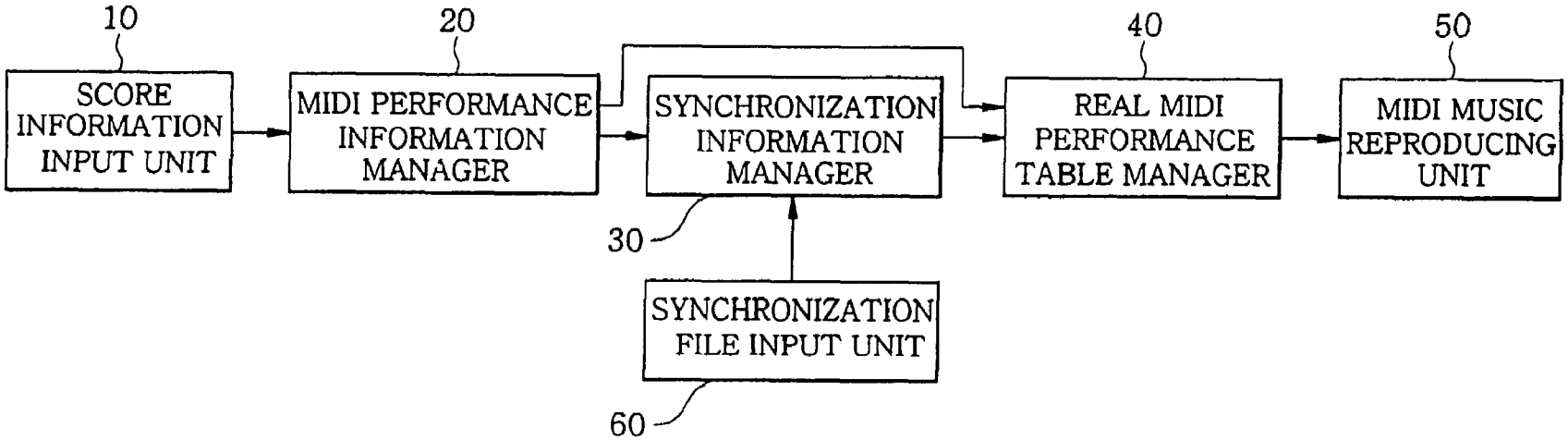
FIG. 1 is a schematic block diagram of an apparatus for reproducing MIDI (music instrument digital interface) music according to a first embodiment of the present invention.

FIG. 1 is a schematic block diagram of an apparatus for reproducing MIDI (music instrument digital interface) music according to a first embodiment of the present invention. Referring to FIG. 1, the apparatus for reproducing MIDI music according to the first embodiment of the present invention includes a score input unit 10, a MIDI performance information manager 20, a synchronization information manager 30, a real MIDI performance table manager 40, a MIDI music reproducing unit 50, and a synchronization file input unit 60.

The score input unit 10 inputs score information containing the pitch and note length information of all notes included in a musical score or MIDI data to be played. The MIDI data is performance information having a format usually used in common and is already known, and thus detailed description thereof will be omitted.

The MIDI performance information manager 20 detects MIDI performance information from the score information and stores and manages the MIDI performance information. The MIDI performance information expresses particulars, which are referred to when music is reproduced in the form of MIDI music, according to a predetermined standard and contains MIDI performance onset time information, MIDI pitch information, MIDI note length information, and MIDI note strength information, as shown in FIG. 3B. The elements, i.e., MIDI performance onset time information, MIDI pitch information, MIDI note length information, and MIDI note strength information, constituting the MIDI performance information are already known concepts, and thus detailed description thereof will be omitted.

The synchronization information manager 30 generates synchronization information, which contains real performance onset time information on an onset time at which each of the notes included in the MIDI performance information is estimated to be performed, from the MIDI performance information or a predetermined synchronization information file and manages the synchronization information.

More specifically, when generating the synchronization information from the MIDI performance information, the synchronization information manager 30 calculates the real performance onset time information of each note included in the MIDI performance information based on the MIDI performance onset time information and MIDI pitch information of the note and generates MIDI synchronization information containing the real performance onset time information, the MIDI performance onset time information, and the MIDI pitch information. In the meantime, when generating the synchronization information from the predetermined synchronization information file, the synchronization information manager 30 reads a synchronization information file, which is input through the synchronization file input unit 60, and generates file synchronization information containing the real performance onset time information, MIDI performance onset time information, and MIDI pitch information of each note included in the MIDI performance information.

FIG. 4A shows an example of the format of the synchronization information. Referring to FIG. 4A, the synchronization information contains real performance onset time information, MIDI performance onset time information, and MIDI pitch information.

The real MIDI performance table manager 40 generates and manages a real MIDI performance table for all of the notes included in the MIDI performance information by matching the MIDI performance information and the synchronization information.

FIG. 4B shows an example of the format of the real MIDI performance table. Referring to FIG. 4B, the real MIDI performance table includes the real performance onset time information, MIDI performance onset time information, MIDI pitch information, MIDI note length information, MIDI note strength information, and performance classification information of each of the notes included in the MIDI performance information. Here, the performance classification information is for identifying whether each of the notes included in the MIDI performance information is a note to be performed by a player or a MIDI note to be reproduced from the MIDI performance information. In particular, when a player performs only a part of a musical score and an automatic accompaniment is reproduced in the form of MIDI music in accordance with the player's performance, the performance classification information is required.

The MIDI music reproducing unit 50 reproduces MIDI music based on the real MIDI performance table.

When the synchronization information is generated from a predetermined synchronization information file, the synchronization file input unit 60 inputs the synchronization information file.

Figure 1A:
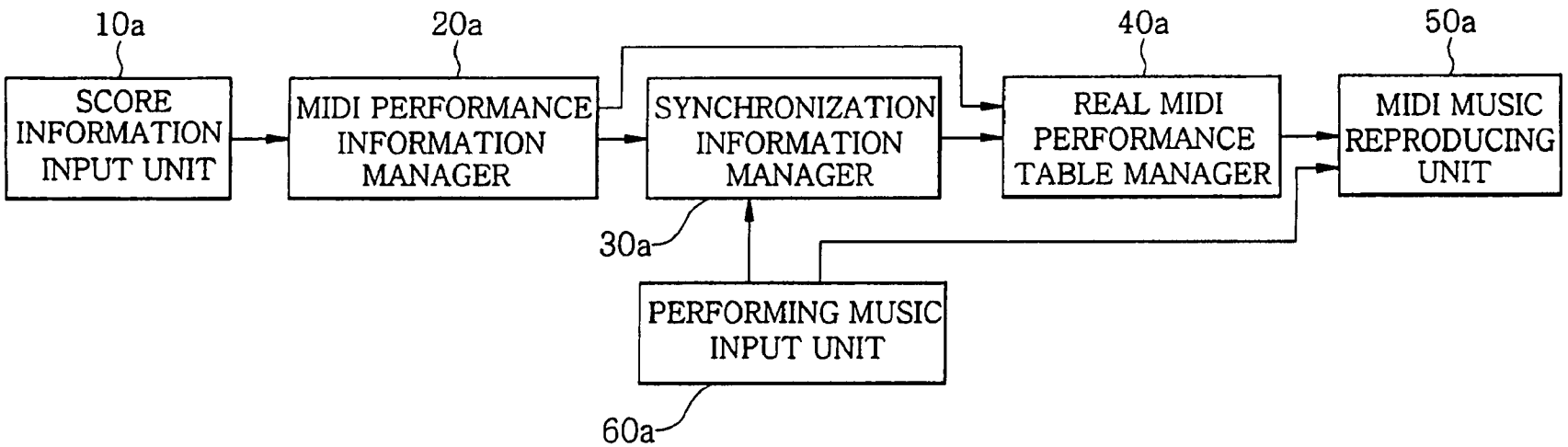
FIG. 1A is a schematic block diagram of an apparatus for reproducing MIDI music according to a second embodiment of the present invention.

FIG. 1A is a schematic block diagram of an apparatus for reproducing MIDI music according to a second embodiment of the present invention. FIG. 1A shows an apparatus for generating synchronization information in real time when only a part of music is performed by a player and automatically reproducing MIDI music corresponding to the remaining part of the music, which is not performed by the player, using the synchronization information.

Referring to FIG. 1A, the apparatus for reproducing MIDI music according to the second embodiment of the present invention includes a score input unit 10*a*, a MIDI performance information manager 20*a*, a synchronization information manager 30*a*, a real MIDI performance table manager 40*a*, a MIDI music reproducing unit 50*a*, and a performing music input unit 60*a*.

The elements of the second embodiment perform the similar operations to those of the first embodiment, with the exception that the performing music input unit 60*a* inputs a performing music to the synchronization information manager 30*a* in real time, and the synchronization information manager 30*a* generates synchronization information from the performing music in real time. Thus, detailed descriptions of the score input unit 10*a*, the MIDI performance information manager 20*a*, the real MIDI performance table manager 40*a*, and the MIDI music reproducing unit 50*a* will be omitted.

The performing music input unit 60*a* receives performing music and transmits the performing music to the synchronization information manager 30*a* and the MIDI music reproducing unit 50*a*. Performing music input through the performing music input unit 60*a* may be real acoustic performing sound, MIDI signal generated from MIDI performance, or performance sound in the form of a wave file.

The synchronization information manager 30*a* detects real performance onset time information and pitch information of current performing music when real performing music is input through the performing music input unit 60*a* and generates synchronization information containing real performance onset time information of a MIDI note, which is contained in the MIDI performance information and matched with the current performing music, in real time based on the real performance onset time information and the pitch information.

Since the synchronization information is generated from the real performing music, the synchronization information manager 30*a* generates the synchronization information in real time as the real performing music is progressed, and the real MIDI performance table manager 40*a* calculates real MIDI performance onset time information of the remaining part of the music, which is not really performed, using the synchronization information and generates a real MIDI performance table based on the real MIDI performance onset time information.

However, when there is MIDI performance information of the music to be performed prior to performing notes of the part of the music to be input through the performing music input unit 60*a*, the real MIDI performance table manager 40*a* generates a real MIDI performance table based on the MIDI performance information so as to reproduce MIDI music based on the real MIDI performance table until the performing music is input through the performing music input unit 60*a*. Thereafter, when the performing music is input through the performing music input unit 60*a* and then the synchronization information manager 30*a* generates synchronization information regarding the input performing music, the real MIDI performance table manager 40*a* matches the synchronization information and the MIDI performance information whenever the synchronization information is generated in order to generate real MIDI performance information regarding the MIDI performance information and adds the real MIDI performance information to the real MIDI performance table so that the MIDI music can be reproduced based on the real MIDI performance table.

Figure 2:
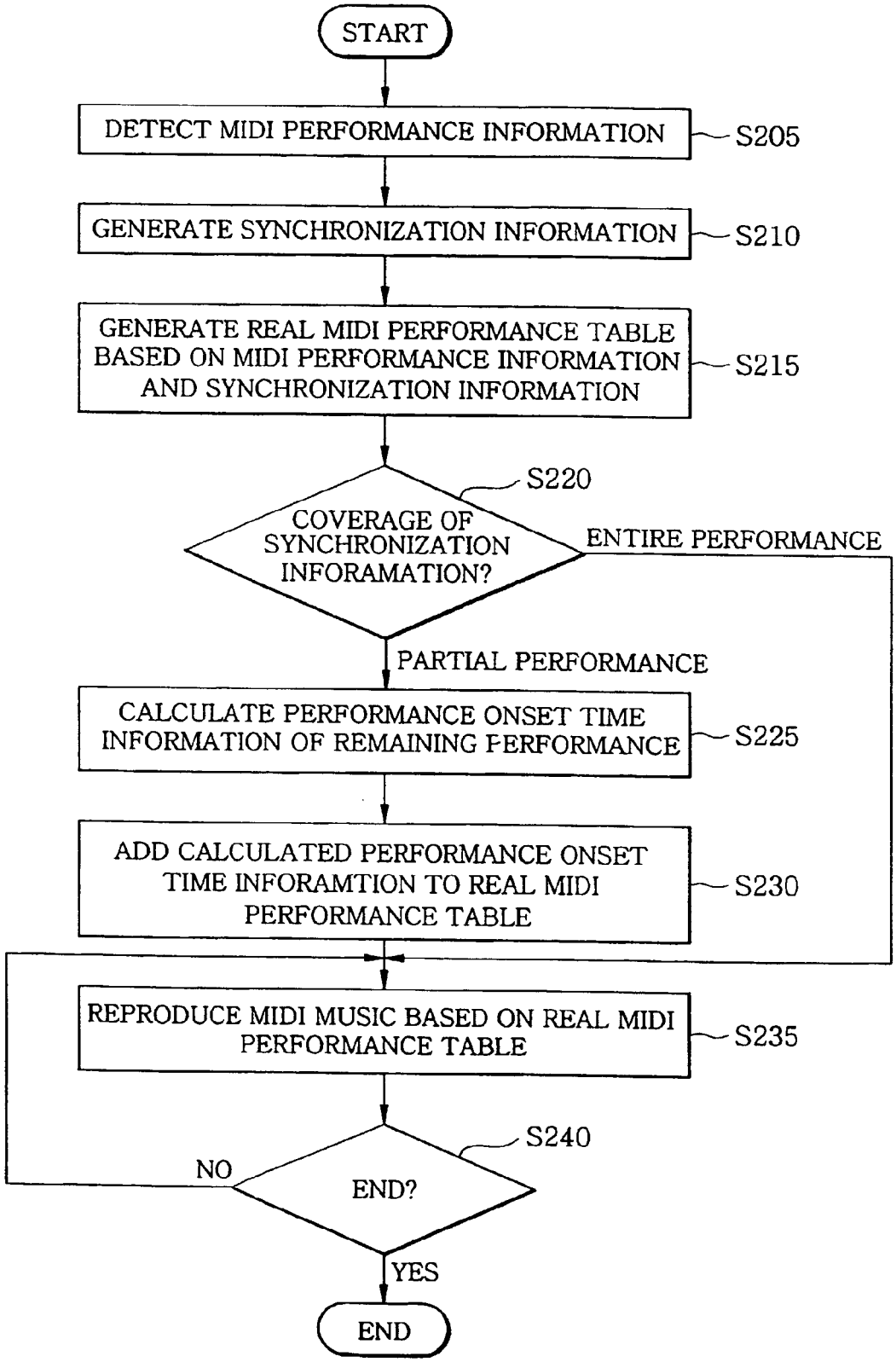
FIG. 2 is a flowchart of a method for reproducing MIDI music using the apparatus according to the first embodiment of the present invention.

FIG. 2 is a flowchart of a method for reproducing MIDI music using the apparatus according to the first embodiment of the present invention.

Referring to FIG. 2, the apparatus for reproducing MIDI music (hereinafter, referred to as a MIDI music reproducing apparatus) according to the first embodiment detects MIDI performance information from a musical score and/or MIDI data to be played in step S205. The MIDI performance information expresses particulars, which are referred to when music is reproduced in the form of MIDI music, according to a predetermined standard and is shown in FIG. 3B. A technique of detecting MIDI performance information from a musical score is already known, and thus detailed descriptions thereof will be omitted.

The MIDI music reproducing apparatus of the first embodiment generates synchronization information, which contains real performance onset time information on an onset time at which each of all notes included in the MIDI performance information is estimated to be performed, from the MIDI performance information or a predetermined synchronization information file in step S210. The generation and format of the synchronization information have been described in the explanation of the operations of the synchronization information manager 30 with reference to FIGS. 1 and 4A, and thus description thereof will be omitted.

Thereafter, the MIDI music reproducing apparatus of the first embodiment matches the MIDI performance information and the synchronization information to generate a real MIDI performance table for the notes included in the MIDI performance information in step S215 and reproduces MIDI music based on the real MIDI performance table in step S235.

The format of the real MIDI performance table has been described in the explanation of the operations of the real MIDI performance table manager 40 with reference to FIGS. 1 and 4B, and thus description thereof will be omitted. After generating the real MIDI performance table, the MIDI music reproducing apparatus checks the range of the synchronization information referred to in order to generate the real MIDI performance table in step S220 and reproduces MIDI music when the synchronization information is matched with entire MIDI note information contained in the MIDI performance information in step S235. When the synchronization information is not matched with the entire MIDI note information contained in the MIDI performance information, the MIDI music reproducing apparatus calculates performance onset time information of the remaining performance in step S225, add the performance onset time information to the real MIDI performance table in step S230, and reproduces the MIDI music based on the real MIDI performance table in step S235. Here, the MIDI music reproducing apparatus calculates the performance onset time information based on a relationship between the real performance onset time information and MIDI performance onset time information of each previous MIDI note matched with the synchronization information. The calculation procedure will be described in detail with reference to FIGS. 4C and 5C.

The MIDI music reproducing apparatus continues the reproducing of the MIDI music through the above-described procedure until an end command is input or the entire performance based on the real MIDI performance table is completed in step S240.

Figure 2A:
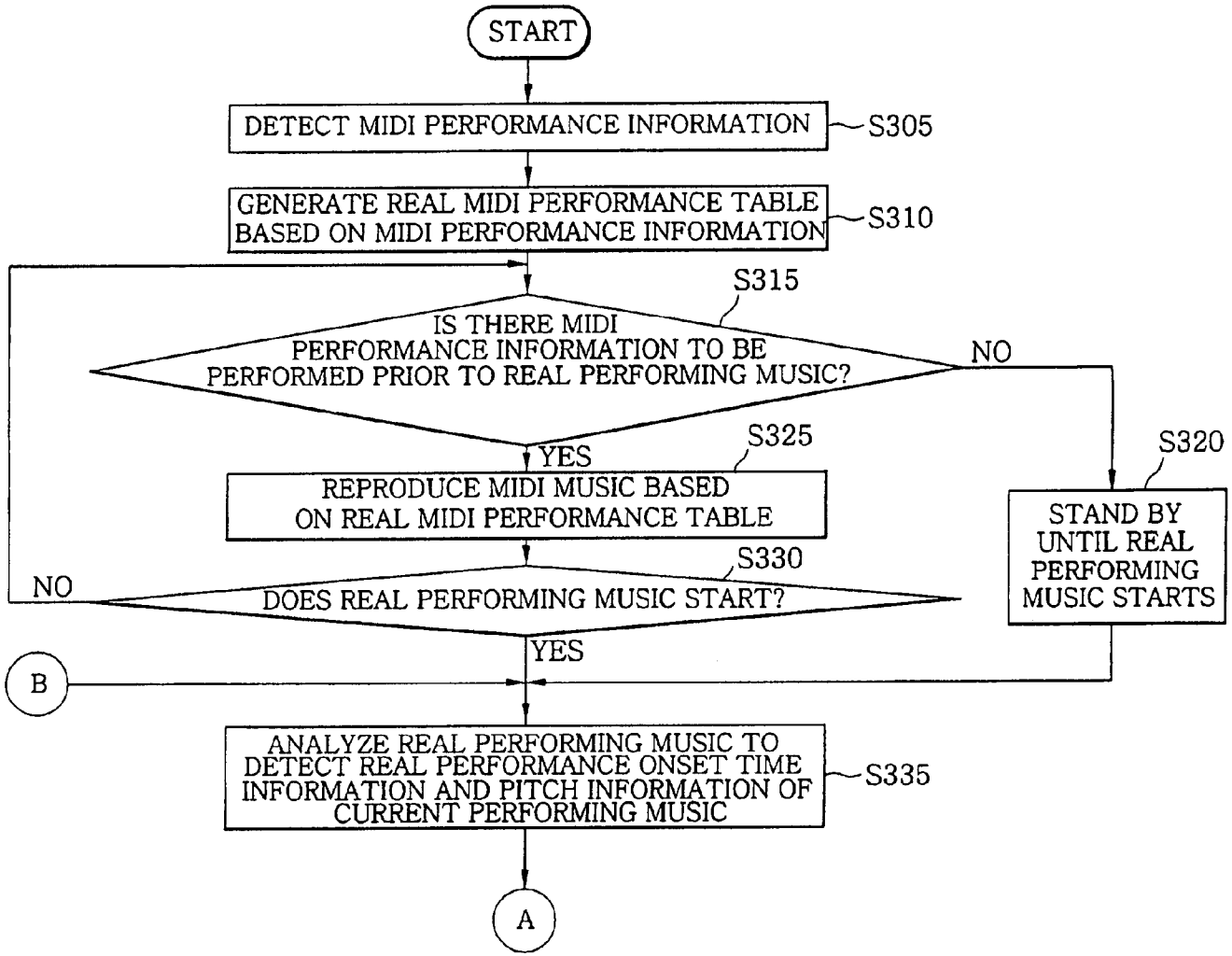
FIG. 2A is a flowchart of a method for reproducing MIDI music using the apparatus according to the second embodiment of the present invention.
Figure 2A:
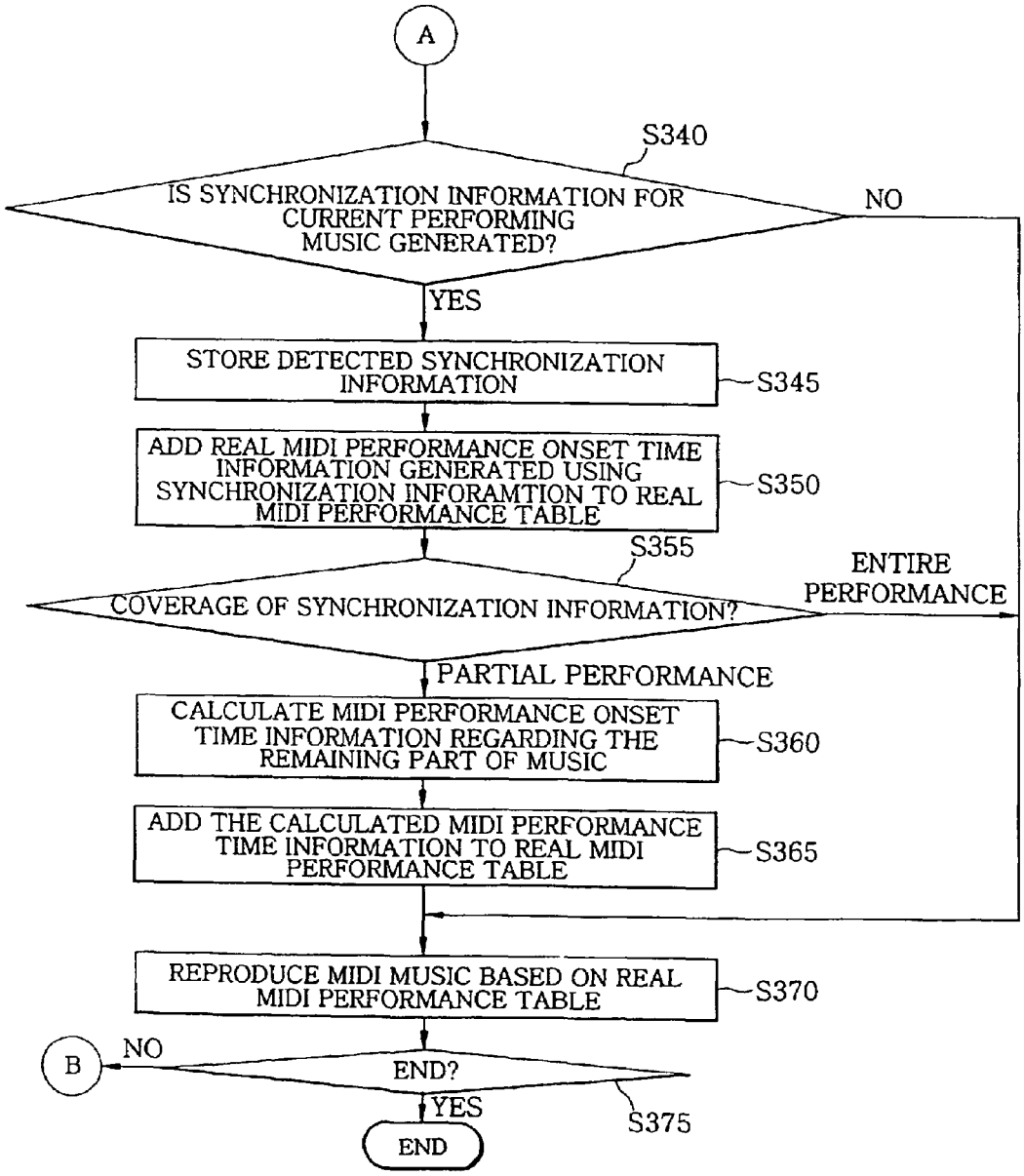

FIG. 2A is a flowchart of a method for reproducing MIDI music using the MIDI music reproducing apparatus according to the second embodiment of the present invention. FIG. 2A shows a procedure for generating synchronization information for performing notes in real time when only a part of music is played by a player and automatically reproducing MIDI music corresponding to the remaining part of the music, which is not played by the player, using the synchronization information.

Referring to FIG. 2A, the MIDI music reproducing apparatus according to the second embodiment of the present invention detects MIDI performance information from a musical score and/or MIDI data to be played in step S305.

In order to prepare a case in which there is MIDI performance information prior to real performing music to be input, the MIDI music reproducing apparatus of the second embodiment generates a real MIDI performance table based on the MIDI performance information in step S310. In this case, since the MIDI music reproducing apparatus has no synchronization information, the MIDI music reproducing apparatus applies basic values to the MIDI performance information and inputs only real performance onset time information of notes prior to the real performing music into the real MIDI performance table. If it is determined that there is the MIDI performance information prior to the real performing music to be input in step S315, the MIDI music reproducing apparatus reproduces the MIDI music based on the real MIDI performance table in step S325 until the real performing music starts in step S330. Otherwise, the MIDI music reproducing apparatus stands by until the real performing music starts in step S320.

If the real performing music starts in step S330, the MIDI music reproducing apparatus analyzes the real performing music to detect real performance onset time information and pitch information of current performing music in step S335 and generates synchronization information, which contains real performance onset time information of each MIDI note matched with the current performing music in the MIDI performance information, based on the real performance onset time information and pitch information of the current performing music in real time in steps S340 and S345.

If the synchronization information is generated, the MIDI music reproducing apparatus matches the generated synchronization information and the MIDI performance information to generate real MIDI performance information of all notes included in the MIDI performance information and adds the real MIDI performance information to the real MIDI performance table in step S350. If synchronization information is not generated, in step S370 the MIDI music is reproduced up to a note immediately before a note in the real MIDI performance table, which is expected to be synchronized with the next note to be performed by a player.

Thereafter, unless an end command is input or the real performing music ends in step S375, the MIDI music reproducing apparatus performs steps S335 and S340 again to analyze the real performing music and check whether synchronization information is generated.

To reproduce MIDI music after the real MIDI performance table is updated in step S350, the MIDI music reproducing apparatus checks the coverage of the synchronization information that is referred to update the real MIDI performance table in step S355 and reproduces the MIDI music in step S370 if the synchronization information is matched with all notes included in the MIDI performance information. Otherwise, i.e., if the synchronization information is not matched with all notes included in the MIDI performance information, the MIDI music reproducing apparatus calculates MIDI performance onset time information regarding the remaining part of music, which is not played by a player, in step S360 and adds the MIDI performance onset time information to the real MIDI performance table in step S365 in real time. Thereafter, the MIDI music reproducing apparatus reproduces the MIDI music based on the real MIDI performance table in step S370. Here, the MIDI music reproducing apparatus calculates the performance onset time information based on a relationship between the real performance onset time information and MIDI performance onset time information of each previous MIDI note matched with the synchronization information. The calculation procedure will be described in detail with reference to FIGS. 4C and 5C.

Thereafter, the MIDI music reproducing apparatus reproduces the MIDI music in step S370 until the end command is input or the real performing music ends in step S375.

FIGS. 3A through 5C are diagrams for illustrating procedures for constructing real MIDI performance tables according to the first and second embodiments of the present invention.

Figure 3A:
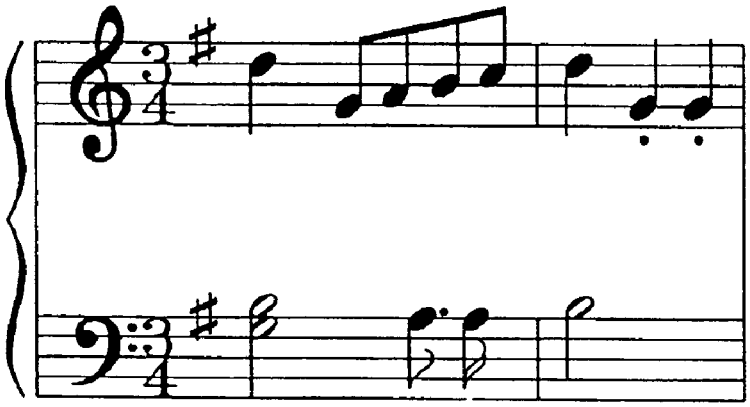

FIG. 3A shows the musical score of the first two measures of the Minuet in G major by Bach. In FIG. 3A, the accompaniment of the first measure is partially changed in order to clarify the description of automatic accompaniment of the present invention.

FIG. 3B shows a part of MIDI performance information, which is detected form the musical score shown in FIG. 3A regarding right hand performance. FIG. 3C shows a part of MIDI performance information, which is detected form the musical score shown in FIG. 3A regarding left hand performance. Referring to FIGS. 3B and 3C, the MIDI performance information includes MIDI performance onset time information, MIDI pitch information, MIDI note length information, and MIDI note strength information.

FIG. 4A shows an example of synchronization information, which is generated from MIDI performance information, predetermined synchronization information file, or real performing music input in real time. Specifically, FIG. 4A shows synchronization information regarding the right hand performance in the musical score shown in FIG. 3A.

FIG. 4B shows a real MIDI performance table, which is generated by matching the synchronization information shown in FIG. 4A and the MIDI performance information shown in FIGS. 3B and 3C. Referring to FIG. 4B, since there exists the synchronization information regarding the right hand performance only, as shown in FIG. 4A, sections for real performance onset time information regarding the left hand performance in the real MIDI performance table are empty, and "accompaniment" is written in sections for classification information regarding the left hand performance.

If there exists synchronization information regarding all notes, the real MIDI performance table shown in FIG. 4B will be completed without blanks, and "synchronization" will be written in all sections for the performance classification information. Accordingly, MIDI music can be reproduced based on the real MIDI performance table.

In the meantime, when there exists synchronization information regarding only partial notes of music, as shown in FIG. 4B, a MIDI music reproducing apparatus according to the present invention will calculate real performance onset time information regarding the remaining notes of the music.

In this situation, when a value of the MIDI performance onset time information is 0, as shown in a case of real performance onset time information 41 or 42, a MIDI note corresponding to the real performance onset time information 41 or 42 is simultaneously performed with an initial performing note, so the MIDI music reproducing apparatus calculates that real performance onset time information of the two MIDI notes is "00:00:00". When real performance onset time information is calculated while real performing music is performed, as shown in a case of real performance onset time information 43 or 44, real performance onset time information of a current MIDI note is calculated based on a relationship between the real performance onset time information and MIDI performance onset time information of previous MIDI notes matched with the synchronization information. In other words, the real performance onset time information of a MIDI note that is not matched with the synchronization information is calculated according to Formula (1).

$$t = t_1 + \frac{(t_1 - t_0)}{(t'_1 - t'_0)} \times (t' - t'_1) \tag{1}$$

Here, t=current real performance onset time information (i.e., real performance onset time information to be added), $t_0$=second previous real performance onset time information, $t_1$=first previous real performance onset time information, t'=current MIDI performance onset time information, $t'_0$=second previous MIDI performance onset time information, and $t'_1$=first previous MIDI performance onset time information.

That is, to calculate the unmatched current real performance onset time information of a MIDI note that is not matched with the synchronization information, the MIDI music reproducing apparatus of the present invention divides a difference between the matched first previous real performance onset time information and the matched second previous real performance onset time information by a difference between the matched first previous MIDI performance onset time information and the matched second previous MIDI performance onset time information, then multiplies the result of division by a difference between current MIDI performance onset time information and the matched first previous MIDI performance onset time information, and then adds the result of multiplication to the matched first previous real performance onset time information.

For example, the real performance onset time information 43 can be calculated according to Formula (2) by applying real values shown in the real MIDI performance table of FIG. 4B to Formula (1).

More specifically, the real performance onset time information t to be calculated is reference numeral 43; the first previous real performance onset time information $t_1$ is (00:

02:00); the second previous real performance onset time information $t_0$ is (00:01:50); the current MIDI performance onset time information t' is 240; the first previous MIDI performance onset time information $t'_1$ is 240; and the second previous MIDI performance onset time information $t'_0$ is 180. Accordingly, Formula (2) is accomplished as follows.

$$t(43) = (00:02:00) + \frac{(00:02:00) - (00:01:50)}{240 - 180} \times (240 - 240) = (00:02:00) + 0 = (00:02:00) \quad (2)$$

Consequently, the real performance onset time information 43 is (00:02:00). Thus-calculated real performance onset time information is considered as matched real performance onset time information when the next unmatched real performance onset time information is calculated.

The real performance onset time information 44 can be calculated according to Formula (3).

More specifically, the real performance onset time information t to be calculated is reference numeral 44; the first previous real performance onset time information $t_1$ is (00:02:50); the second previous real performance onset time information $t_0$ is (00:02:00) that is calculated according to Formula (2); the current MIDI performance onset time information t' is 330; the first previous MIDI performance onset time information $t'_1$ is 300; and the second previous MIDI performance onset time information $t'_0$ is 240. Accordingly, Formula (3) is accomplished as follows.

$$t(44) = (00:02:50) + \frac{(00:02:50) - (00:02:00)}{300 - 240} \times (330 - 300) = (00:02:50) + \frac{(00:00:50)}{60} \times 30 = (00:02:50) + (00:00:25) = (00:02:75) \quad (3)$$

Consequently, the real performance onset time information 44 is (00:02:75).

FIG. 4C shows a real MIDI performance table that is completed through the above-described calculation.

FIGS. 5A through 5C are diagrams for illustrating a procedure for generating the accompaniment in accordance with a player's performance tempo. FIGS. 5A through 5C show a procedure for generating a real MIDI performance table using synchronization information, as shown in FIG. 5A, in which time intervals in real performance onset time information are longer than those shown in FIG. 4A with respect to the same time intervals in MIDI performance onset time information as those shown in FIG. 4A.

FIG. 5B shows a real MIDI performance table, which is generated by matching the synchronization information shown in FIG. 5A and the MIDI performance information shown in FIGS. 3B and 3C. FIG. 5C shows a real MIDI performance table completed by calculating real performance onset time information corresponding to the accompaniment using Formula (1).

A procedure for calculating real performance onset time information 51, 52, 53, and 54 is similar to that described above with reference to FIG. 4B, and thus description thereof will be omitted.

The above description just concerns embodiments of the present invention. The present invention is not restricted to the above embodiments, and various modifications can be made thereto within the scope defined by the attached claims. For example, the shape and structure of each member specified in the embodiments can be changed.

INDUSTRIAL APPLICABILITY

According to the present invention, even if musical trainees do not have real performance sound played by a desired player, they can reproduce and listen to the player's performing music with only a small amount of score information and synchronization information. Accordingly, it is not necessary to store a large amount of real performance sound for musical training, thereby accomplishing economical and efficient musical training. In addition, according to the present invention, when a player performs only a part of music, MIDI music corresponding to the remaining part of the music can be automatically reproduced based on synchronization information, which is generated regarding the performing notes played by the player in real time, thereby providing an automatic accompaniment function.

What is claimed is:

1. A method for reproducing MIDI (music instrument digital interface) music based on synchronization information, the method comprising:

a first step of detecting MIDI performance information from a musical score or MIDI data;

a second step of generating synchronization information, which contains real performance onset time information on an onset time at which each of all notes included in the MIDI performance information is estimated to be performed, from the MIDI performance information or a predetermined synchronization information file;

a third step of matching the MIDI performance information and the synchronization information to generate a real MIDI performance table for the notes included in the MIDI performance information; and a fourth step of reproducing MIDI music based on the real MIDI performance table, wherein the real MIDI performance table comprises the real performance onset time information, MIDI performance onset time information, MIDI pitch information, MIDI note length information, MIDI note strength information, and performance classification information of each of the notes included in the MIDI performance information, the performance classification information identifying whether each of the notes included in the MIDI performance information is a note to be performed by a player or a MIDI note to be reproduced from the MIDI performance information.

2. The method of claim 1, wherein the synchronization information comprises real performance onset time information, MIDI performance onset time information, and MIDI pitch information of each of the notes included in the MIDI performance information.

3. The method of claim 1, wherein when the synchronization information is generated from the MIDI performance information, the second step comprises calculating the real performance onset time information of each note included in the MIDI performance information based on the MIDI performance onset time information and MIDI pitch information of the note and generating MIDI synchronization information containing the real performance onset time information, the MIDI performance onset time information, and the MIDI pitch information.

4. The method of claim 1, wherein when the synchronization information is generated from the predetermined synchronization information file, the second step comprises reading the synchronization information file and generating file synchronization information containing the real performance onset time information, MIDI performance onset time information, and MIDI pitch information of each note included in the MIDI performance information.

5. The method of claim 1, wherein when the synchronization information is not matched with all of the MIDI notes included in the MIDI performance information, the third step comprises calculating real performance onset time information of each current MIDI note, which is not matched with the synchronization information, based on a relationship between the real performance onset time information and MIDI performance onset time information of previous MIDI notes matched to the synchronization information.

6. A method for reproducing MIDI (music instrument digital interface) music based on synchronization information, the method comprising:

a first step of detecting MIDI performance information from a musical score or MIDI data;

a second step of detecting real performance onset time information and pitch information of current real performing music when real performing music is input and generating synchronization information, which contains real performance onset time information of a MIDI note matched with the current performing music and included in the MIDI performance information, in real time based on the real performance onset time information and pitch information of the current performing music;

a third step of generating a real MIDI performance table regarding all notes included in the MIDI performance information by matching the generated synchronization information and the MIDI performance information; and a fourth step of reproducing MIDI music based on the real MIDI performance table, wherein the real MIDI performance table comprises the real performance onset time information, MIDI performance onset time information, MIDI pitch information, MIDI note length information, MIDI note strength information, and performance classification information of each of the notes included in the MIDI performance information, the performance classification information identifying whether each of the notes included in the MIDI performance information is a note to be performed by a player or a MIDI note to be reproduced from the MIDI performance information.

7. The method of claim 6, further comprising the step of when there is the MIDI performance information to be performed before the real performing music is input, generating a real MIDI performance table based on the MIDI performance information and reproducing MIDI music based on the generated real MIDI performance table until the real performing music is input.

8. The method of claim 6, wherein the synchronization information comprises real performance onset time information, MIDI performance onset time information, and MIDI pitch information of each of the notes included in the MIDI performance information.

9. The method of claim 6, wherein when the synchronization information is not matched with all of the MIDI notes included in the MIDI performance information, the third step comprises calculating real performance onset time information of each current MIDI note, which is not matched with the synchronization information, based on a relationship between the real performance onset time information and MIDI performance onset time information of previous MIDI notes matched to the synchronization information.

10. An apparatus for reproducing MIDI (music instrument digital interface) music based on synchronization information, the apparatus comprising:

a score input unit for inputting score information containing pitch and note length information of all notes included in a musical score or MIDI data to be played;

a MIDI performance information manager for detecting MIDI performance information from the score information and storing and managing the MIDI performance information;

a synchronization information manager for generating synchronization information, which contains real performance onset time information on an onset time at which each of the notes included in the MIDI performance information is estimated to be performed, from the MIDI performance information or a predetermined synchronization information file and managing the synchronization information;

a real MIDI performance table manager for generating and managing a real MIDI performance table for all of the notes included in the MIDI performance information by matching the MIDI performance information and the synchronization information; and a MIDI music reproducing unit for reproducing MIDI music based on the real MIDI performance table, wherein the real MIDI performance table comprises the real performance onset time information, MIDI performance onset time information, MIDI pitch information, MIDI note length information, MIDI note strength information, and performance classification information of each of the notes included in the MIDI performance information, the performance classification information identifying whether each of the notes included in the MIDI performance information is a note to be performed by a player or a MIDI note to be reproduced from the MIDI performance information.

11. The apparatus of claim 10, wherein when generating the synchronization information from the MIDI performance information, the synchronization information manager calculates the real performance onset time information of each note included in the MIDI performance information based on the MIDI performance onset time information and MIDI pitch information of the note and generates MIDI synchronization information containing the real performance onset time information, the MIDI performance onset time information, and the MIDI pitch information.

12. The apparatus of claim 10, wherein when generating the synchronization information from the predetermined synchronization information file, the synchronization information manager reads the synchronization information file and generates file synchronization information containing the real performance onset time information, MIDI performance onset time information, and MIDI pitch information of each note included in the MIDI performance information.

13. The apparatus of claim 10, further comprising a performing music input unit for inputting real performing music, wherein the synchronization information manager detects real performance onset time information and pitch information of a current real performing music from the real performing music input through the performing music input unit; generates synchronization information, which contains real performance onset time information of a MIDI note matched with the current performing music and included in the MIDI performance information, in real time based on the real performance onset time information and pitch information of the current performing music.

14. The apparatus of claim 13, wherein when there is the MIDI performance information to be previously performed before the real performing music is input through the performing music input unit, the real MIDI performance table manager generates a real MIDI performance table based on the MIDI performance information; generates real MIDI performance information regarding all of the notes included in the MIDI performance information by matching the generated or updated synchronization information and the MIDI performance information; and adds the real MIDI performance information to the real MIDI performance table.

* * * * *